United States Patent [19]

Boon

[11] 4,456,402

[45] Jun. 26, 1984

[54] METHOD FOR INCREASING THE STABILITY OF AN ARTIFICIAL ISLAND BY MEANS OF PRE-LOADING

[75] Inventor: Bart Boon, Schiedam, Netherlands

[73] Assignee: Gusto Engineering B.V., Schiedam, Netherlands

[21] Appl. No.: 184,978

[22] Filed: Sep. 8, 1980

[30] Foreign Application Priority Data

Sep. 7, 1979 [NL] Netherlands ..... 7906710

[51] Int. Cl.[3] ..... E02B 17/08

[52] U.S. Cl. ..... 405/196; 405/206; 405/207

[58] Field of Search ..... 405/18, 172, 195, 196, 405/200, 203, 205, 206, 207, 216, 224

[56] References Cited

U.S. PATENT DOCUMENTS

| | | | |
|---|---|---|---|
| 2,318,685 | 5/1943 | Gross | 405/205 |
| 2,422,168 | 6/1947 | Kirby | 405/205 |
| 2,476,309 | 7/1949 | Lang | 405/205 X |
| 2,552,899 | 5/1951 | Manes | 405/206 |
| 3,064,437 | 11/1962 | Knapp | 405/206 |
| 3,097,495 | 7/1963 | Laborde et al. | 405/205 |
| 3,277,653 | 10/1966 | Foster . | |
| 3,453,830 | 7/1969 | Mitchell . | |
| 3,861,158 | 1/1975 | Swain et al. | 405/172 |

OTHER PUBLICATIONS

"A New Design for a Concrete Oil Platform" in the periodical PT Bouwkunde, Pt. 31, May 1976, pp. 324 & 325.

"The Design and Construction of Offshore Drilling Outfits" in the periodical Petroleum, vol. 30, Jul.-Aug. 1967, pp. 141-146.

*Primary Examiner*—David H. Corbin

*Attorney, Agent, or Firm*—Young & Thompson

[57] ABSTRACT

The invention relates to a method for pre-loading the legs (2,3,4) of an artificial island (1) to increase the stability of the island preloading is performed by ballast (7-17) placed in or on the legs, this ballast being preferably located within flexible bags (17,18,19,22,23,24,25,26,27,33,34,48,49,50,51) placed upon the trussed members (11,12,13,14,15,16) of the legs or upon a plateau (46) supported by beams (45). Instead of bags a rigid receptacle formed by plates (37-40) can be used for receiving ballast. Furthermore, the hollow tubular members (52,53,54,55) can be used for receiving liquid ballast.

5 Claims, 14 Drawing Figures fig-2b
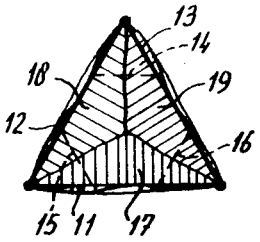
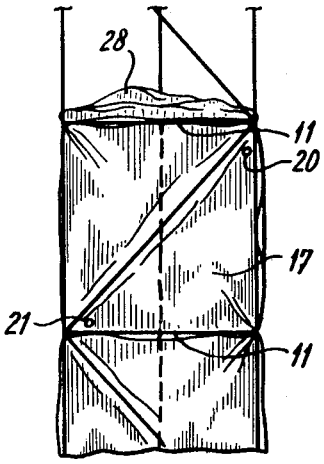
fig-2a
fig-3b
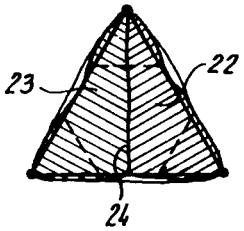
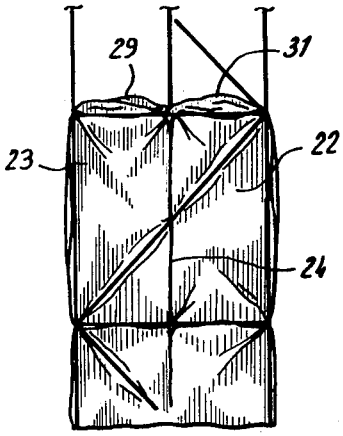
fig-3a
fig-4b
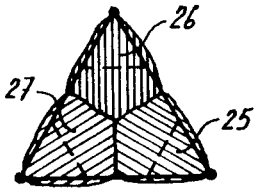
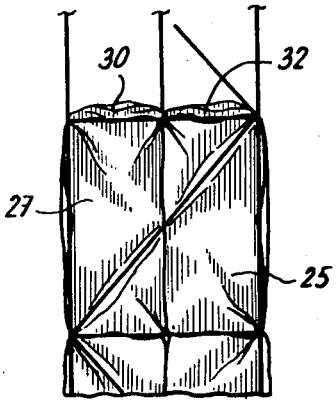
fig-4a fig-5b
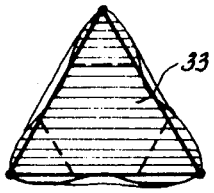
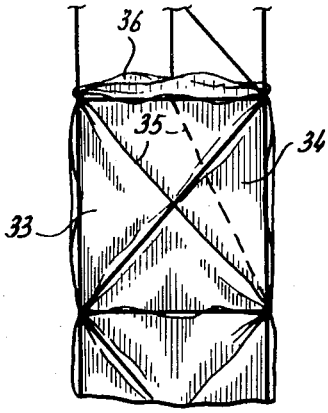
fig-5a
fig-6b
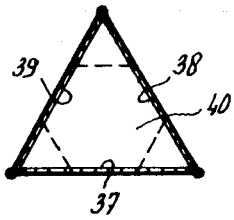
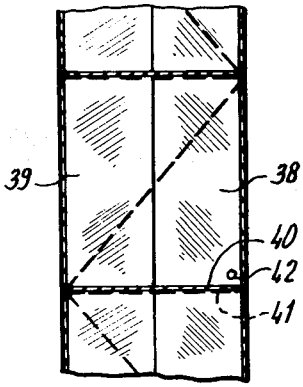
fig-6a
fig-7b
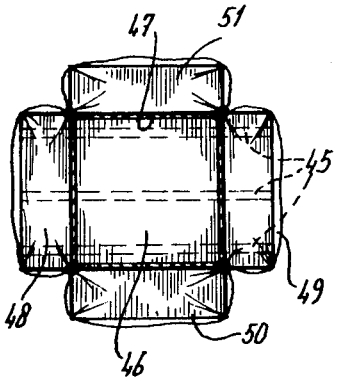
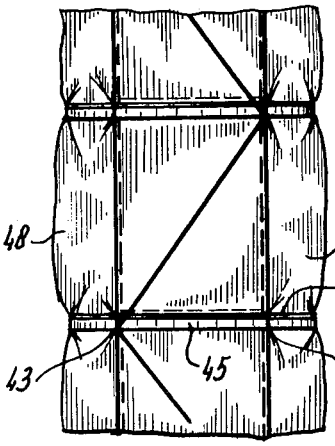
fig-7a

Figure 1:
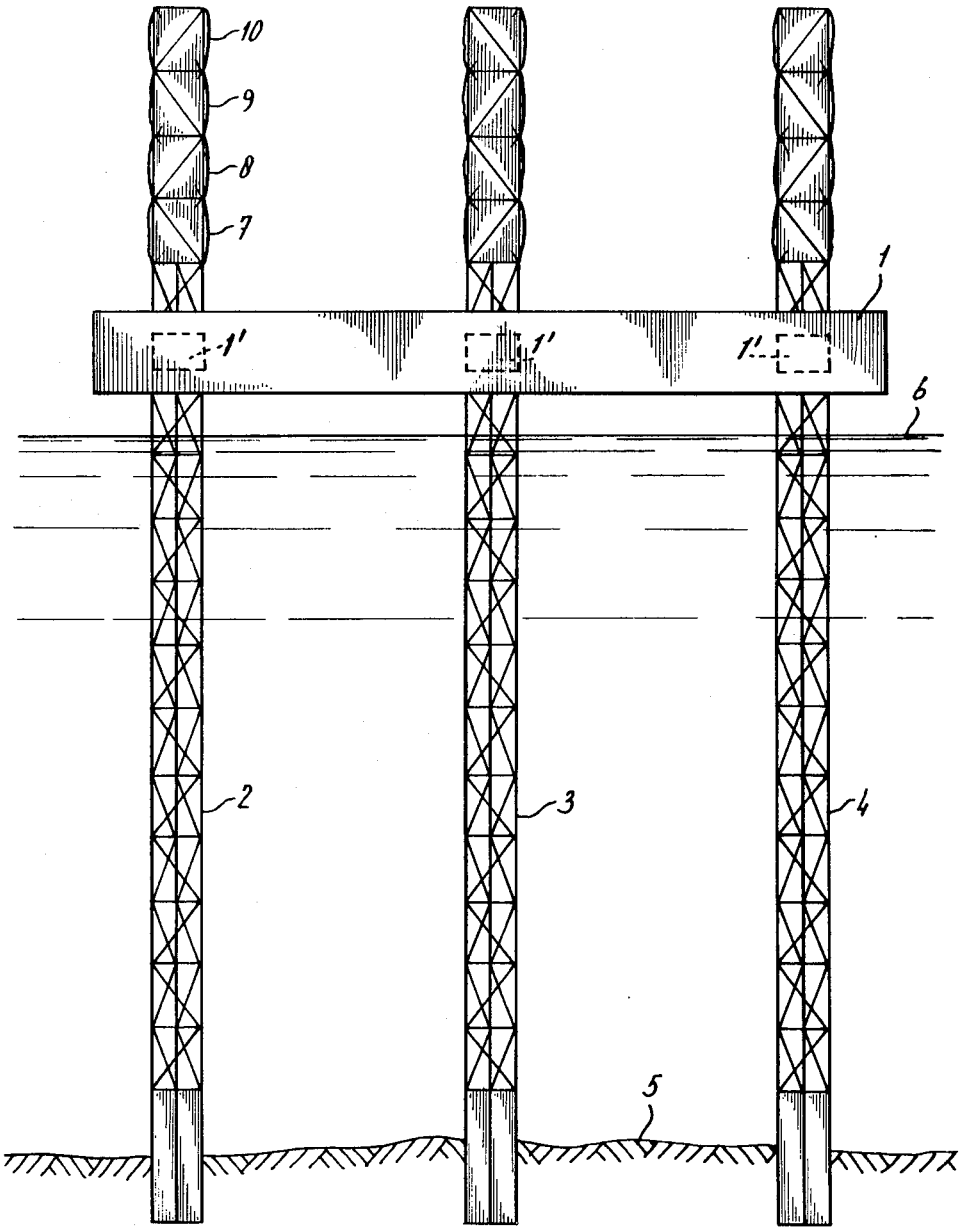

METHOD FOR INCREASING THE STABILITY OF AN ARTIFICIAL ISLAND BY MEANS OF PRE-LOADING

This invention relates to a method and device for increasing the stability of an artificial island by means of pre-loading, said island standing with its legs on the bottom of a body of water and comprising a platform in the form of a pontoon, said pontoon being relatively movable and attachable with respect to said legs, said process of pre-loading being performed by temporarily providing a ballast which can be removed.

A method of this kind is generally known. In the case of artificial islands which are not resting on a rocky ocean floor but on a comparatively soft sea bed, the legs have to be provided with such high loads that under all weather and loading conditions the leg will not sink further into the bottom. The so-called pre-loading is performed by providing the legs with an additional load. In the case of islands which have four or more legs, the pre-loading is performed by having the weight of the island act on two or three legs, in which the weight is increased with the aid of the mass of the other legs. The consequence is that the jacking and locking mechanisms, with which the legs are movable with respect to the pontoon, have to bear the additional heavy load during the pre-loading.

In the case of islands which have three legs, it is not possible to use the island's own mass for the pre-loading of the legs. The additional forces are then obtained by the provision of additional ballast, i.e. water ballast in compartments of the pontoon which are available for this specific purpose and which, therefore, cannot be used otherwise, or by temporarily positioning heavy concrete blocks on deck. The jacking-locking mechanisms should resist the full load also in the case of the pre-loading last mentioned, in which case the placing on deck and removal of the blocks will be an additional complication. However, water ballast can be provided by means of a pump and it can be drained off easily.

It is the object of this invention to provide a method, with which during the pre-loading the means for locking the legs relative to the pontoon and for moving said legs do not require additional heavy loading. In accordance with the present invention said object is achieved in that the ballast is placed in or on the legs, and in that said ballast is provided in or on receptacles or bearing means releasably attached to or in said legs. Thus, the invention is based on the principle that the ballast acts no longer on the legs via the locking means but that it acts directly on said legs, e.g. by providing the ballast in the hollow trussed members of the legs. In a large number of cases the legs consist of tubular members. When these members are filled with ballast, e.g. water, the leg can be provided with an additional weight which is not visible from the outside.

When in accordance with the invention flexible bags for ballasting purposes are used, said bags being supported on the bracing members of the legs, it is preferred to position said bags when they are empty; consequently, they can be filled only when they are already placed in or on the legs. When the pre-loading has been performed the ballast can easily be removed and the bags can then be removed so that the legs can regain their profile which offers as little resistance to wave and wind action as possible.

Naturally, it is also possible to place the bags in filled condition, provided that their dimensions permit movement through the openings of the framework of a leg. Said movement is not needed when bearers are used for the supporting of the bags; the bearers project beyond the legs and the ballast is placed thereon. It is then also possible to use bags which are filled after they have been placed.

When filled bags are used they are disposed on the pontoon before they are placed on a leg. As the pontoon is disposed at a slight distance above sea level during the pre-loading the weight of the filled bags resting on the pontoon will also subject the locking means to a load. However, said load does not correspond to the entire ballast needed for the pre-loading because it is not necessary to have all bags in filled condition at the same time on the pontoon, as is required when using heavy blocks according to the known method. It is possible to fill the bags one by one on the pontoon and subsequently transport them to the requisite place on or in a leg by means of a hoisting device.

If necessary, a plateau can be used which rests on the trussed members of a leg. Said plateau may constitute the floor of a reservoir consisting of a member of parts and carry same. The bags can be placed in said reservoir or the reservoir as such can be filled with water when the parts are sealingly connected to each other.

Instead of water, it is also possible to use substances with a higher specific weight, such as barite, which, in the case of a marine structure for offshore drilling is usually available on board or in the vicinity for making a fluid mud. If a fluid mud composed of barite is used, one should take care that the fluid in the bags is kept in motion, because otherwise it will harden and the bags cannot be emptied any more. The problem does not arise when specific chemicals are added to the fluid mud which maintain its fluidity.

It is preferred to use a bag which is provided with means required for the lifting, filling and emptying of said bag.

It is evident that the ballasting with receptacles, such as bags, to be mounted in or on the legs can also be carried out in combination with the filling of the hollow trussed members. When, in doing so, fluid mud is used for the filling of the trussed members, the risk of hardening can be avoided by keeping the fluid mud in circulation, e.g. by the provision of a pump in one of the vertical leg portions. In the case of a leg construction which can be used when applying the method in accordance with the invention, the hollow trussed members are connected together and a discharge opening, which can be closed, is provided in the proximity of or below the water level when the leg is positioned on the bottom, and a filling hole is provided at a considerable distance from the discharge opening, i.e. above the water level. e.g. When the leg is filled with water up to the top and the discharge opening is opened the water will recede and reach the level of the water outside. When a fluid mud is used, it can be expelled by means of a pump or it can flow on the ocean floor via the discharge opening. The filling takes place via a separate supply opening or through the open upper end portions of the vertical trussed members.

However, if it is desirable that the interior of the framework structure be kept dry, only the tanks or the like to be attached to or on the legs are suitable.

Figure 8:
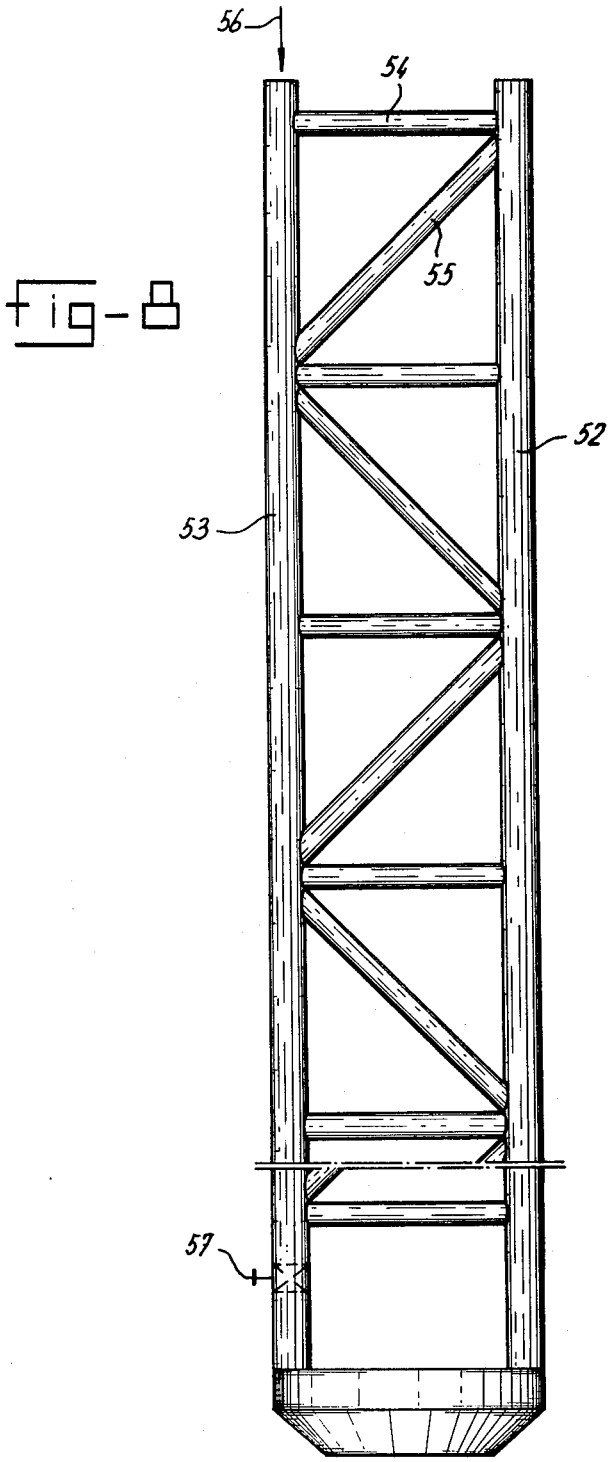

The invention will now be explained more in detail with reference to the accompanying drawings, in which:

FIG. 1 is a diagrammatic side elevation of an artificial island, in which the method in accordance with the invention is applied;

FIGS. *2a, 2b* through *7a, 7b* inclusive are side elevations and plan views respectively of different embodiments for applying the method in accordance with the invention; and FIG. 8 is a side elevation of a leg comprising hollow trussed members.

FIG. 1 illustrates a pontoon 1 of an artificial island having three legs 2,3 and 4. There is a conventional jacking and locking mechanism 1' for shifting each leg lengthwise relative to pontoon 1 and for locking it in any shifted position. For the greater part of their length said legs comprise trussed members with closed lower end portions which can be pressed into the bottom 5. During the initial pressing the pontoon 1 is positioned at a slight distance above sea level 6.

As is apparent from FIG. 1, bags 7–10 are provided in the upper part of each leg between the trussed members. As is shown, each leg has four large bags. It is evident, however, that said bags need not be disposed in the upper part of the legs.

As illustrated in FIGS. *2a* and *b*, the space between the horizontal trussed members 11, 12 and 13 of a triangular leg (in horizontal section) is filled with bars 14, 15 and 16 on which, if required with the insertion of a plateau resting on the horizontal trussed members 11–16, three bags 17, 18 and 19 are placed. In empty condition, said bags can be placed in the space between the trussed members and filled via opening 20. After having been used, said bags can be emptied via opening 21. The bags are made of e.g. reinforced rubber so that, in filled condition, they are clamped between the trussed members, whereby they may bulge slightly outwards.

As shown in FIGS. *3a* and *3b*, the space is also filled with bags, i.e. only two bags 22 and 23, which butt against each other along plane 24.

FIGS. *4a* and *4b* illustrate three bags 25, 26 and 27. The empty bags are illustrated in the Figures by reference numerals 28, 29, 30, 31 and 32.

In the embodiment illustrated in FIGS. *5a* and *5b* two bags 33 and 34 are used. Said bags are lying on top of each other along the lines 35. Reference numeral 36 indicates an empty bag.

In the embodiment illustrated in FIGS. *6a* and *6b* the receptacle for the ballast comprises a rigid structure formed by wall plates 37, 38 and 39 and bottom plate 40. Said bottom plate rests on the trussed members indicated by reference numeral 41. The wall plates and bottom plate can be sealingly connected to each other and they constitute a reservoir which is open at the top, which can be filled at the top and which can be emptied via a discharge opening 42.

FIGS. *7a* and *7b* show a leg having a square section. Beams 45 are disposed on two opposed horizontal trussed members 43, 44 and a plateau is provided on said beams. The beams and the plateau project beyond the trussed members. A reservoir consisting of plates 47 sealingly connected to each other is provided inside the trussed members, analogous to FIGS. *6a* and *6b*, and bags 48 and 49 or the like may be placed on the parts of the plateau 46 which project beyond the trussed members. As illustrated in FIG. *7b*, this embodiment can also be provided on the other two sides of the framework, in which case the bags are indicated by reference numerals 50 and 51 and a second plateau, analogous to plateau 46, is positioned across plateau 46 and perpendicular thereto.

FIG. 8 is a diagrammatic side view on a slightly enlarged scale of a leg construction comprising vertical tubular members 52, 53. In the case of a rectangular cross-section, there are four of said tubular members and a triangular cross-section shows three tubular members. Only one side face is illustrated but the other faces of the leg are identical. Horizontal and diagonal tubes 54 and 55 respectively are provided between vertical tubes 52,53. All tubular members are hollow and they are welded together in such a way that they communicate with each other at the joints.

A construction of this kind can be ballasted with a fluid which is admitted via an open upper end, e.g. in the region of arrow 56, and which can be expelled through a valve 57, shown only diagrammatically.

It is evident that the drawings show only a few of the numerous changes and modifications which can be practiced within the spirit of the invention.

Another advantage of the bags to be used for ballasting purposes is that in empty condition they do not take up much room on board and their weight is negligible. However, if during the movement of the platform, whereby the pontoon is travelling and the legs are retracted, ballast is needed for the trimming of the platform, it is possible to position one or more filled bags at the proper place in a simple manner.

An important advantage of the method and device in accordance with the invention is that when the preloading of the legs has been performed and the ballast has been taken away the legs regain their profile which is most favourable to withstand wave and wind action.

Instead of liquid ballast it is also possible to use solid blocks which are placed on bearers projecting beyond the outer legs, as shown in FIGS. *7a* and *b*. When applying this invention, the advantage as to the loading of the locking means is gained only when most of the blocks are placed directly from lighters onto the bearers and when after the pre-loading they are placed back on the lighters so that they do not subject the pontoon to unnecessary loading.

I claim:

1. Method for increasing the stability of an artificial island of the type comprising a pontoon having a plurality of individual legs of open frame structure, which pontoon and legs are movable with respect to each other by means of a jacking mechanism, locking means being provided between the pontoon and each leg to secure the legs and pontoon is a selected fixed position with respect to each other, the method comprising increasing the stability by temporarily ballasting each leg of open frame structure individually, by providing the legs to be ballasted above water level with supports, by placing upon said supports detachable ballasting containers which are held in place by the open frame structure of the legs, and by filling said containers with ballast.

2. Method as claimed in claim 1, wherein the containers are flexible bags, said bags being supported by the open frame structure of the legs.

3. Method as claimed in claim 2, characterized in that the bags are placed when they are empty and that said bags are subsequently filled.

4. Method according to claim 2 wherein the bags are placed in filled condition and that their dimensions permit movement through openings of the open frame structure of a leg.

5. A method as claimed in claim 1, in which said locking means of the individually ballasted leg is disengaged during ballasting.

* * * * *